United States Patent [19]

Massa

[11] 4,341,146

[45] Jul. 27, 1982

[54] COMBINED TENOR AND SOPRANO SAXOPHONE

[76] Inventor: Louis B. Massa, Bergenfield, N.J.

[21] Appl. No.: 231,682

[22] Filed: Feb. 5, 1981

[51] Int. Cl.[3] ..... G10D 15/00

[52] U.S. Cl. ..... 84/381; 84/385 R

[58] Field of Search ..... 84/170, 381, 385 R, 84/385 B

[56] References Cited

U.S. PATENT DOCUMENTS 2,232,151 2/1941 Trew ..... 84/385 R

*Primary Examiner*—Lawrence R. Franklin

*Attorney, Agent, or Firm*—Donald R. Heiner

[57] ABSTRACT

A musical instrument combining a modified portion of a tenor saxophone with a modified portion of a soprano saxophone joined together by means of a bracket whereby one of the two instruments can be moved relative to the other to obtain proper alignment whereby the two instruments can be played simultaneously. Each of the two instruments is provided with its own mouthpiece whereby a musician may play two notes simultaneously. Each instrument is also fitted with a trumpet bell outlet.

8 Claims, 5 Drawing Figures

COMBINED TENOR AND SOPRANO SAXOPHONE

BACKGROUND OF THE INVENTION

The present invention relates generally to the field of musical wind instruments and more particularly to the field of saxophones wherein a modified portion of a tenor saxophone and a modified portion of a soprano saxophone are joined together by means of a bracket which allows one of the two instruments to be moved relative to the other until proper alignment has been obtained thus allowing a musician to play both instruments simultaneously. The outlet or discharge end of each instrument are provided with trumpet bells rather than with the standard saxophone outlets.

The two instruments are modified from the standard tenor and soprano saxophones by altering some of the tone holes. The basic instruments, prior to modification, are a B flat tenor saxophone and a B flat straight soprano saxophone.

The standard B flat tenor saxophone and B flat straight soprano saxophone currently in use cannot be combined to be played simultaneously to yield two notes at the same time. The various modifications to the two instruments disclosed below are also not known.

SUMMARY OF THE INVENTION

Briefly, the invention relates to a novel musical instrument comprising a portion of a B flat tenor saxophone and a portion of a B flat straight soprano saxophone each fitted with a trumpet bell outlet and connected by means of a plate which will allow the soprano portion to slide relative to the tenor portion until such time as the musician has satisfied himself with the tone at which time nuts securing the tenor portion to the plate are secured. At this time, neither the tenor nor the soprano section can be moved relative to the other and both mouthpieces are properly aligned for playing. The brackets are connected to the neck of the soprano portion and the rail is connected to the neck of the tenor portion. The instruments themselves have been modified by the opening up or plugging of various existing holes.

As to the tenor section, in general, the G sharp and the lever to operate the G sharp have been removed. The basic tenor section is cut off slightly below the F sharp tone hole which is then fitted with a large key cup. A regular trumpet bell is then fitted to the F sharp tone hole. Three caps are provided to block off three existing tone holes. An open cap or washer element known as a tone chamber is secured over the F tone hole for the purpose of keeping the G note in tune.

As to the soprano section, the same notes blocked off in the tenor section are also blocked off in the soprano section. The soprano section is cut off above the F sharp tone and a standard trumpet bell is also fitted to this soprano section as in the tenor section. The octave key of the soprano section was removed and the post holding it to the instrument was moved downwardly to give clearance for the mouthpiece so that it could be moved for tuning purposes. A bend is made to the octave key so that it could cover the tone hole without interference with the mouthpiece. On this soprano section three upper stack keys are bent to allow simplified key fingering by the musician.

On both the tenor section and the soprano section of the instrument which forms the subject matter of this application the notes that are blocked off from top to bottom, on both instruments, beginning with the upper most stack, are the E tone hole, side tone hole, C tone hole, and another side tone hole located about half of the way down from the upper stack, and, the B flat tone hole.

Therefore, the keys on both the tenor and soprano portions of the instrument which form the subject matter of this application from top to bottom, will be as follows: F, E flat, D, B, B flat, A and G. By various fingering of the above-mentioned keys the instrument will yield the following notes: F, E flat, D, C sharp, C, B, B flat, A, and G. There is no F sharp. If the player hits the octave key on either the tenor or soprano section the same notes as above will be heard but at an octave above.

The scales of the normal tenor and soprano saxophones which have been modified by this invention are B flat, B, C, C sharp, D, D sharp, E, F, F sharp, G, G sharp, A, B flat, B, C, C sharp, D, D sharp, E, F, F sharp, G, G sharp, A, B flat, B, C, C sharp, D, D sharp, E, and F.

Accordingly, it is an object of the invention to provide a novel musical instrument.

Another object of the invention is to provide a novel musical instrument combining a tenor saxophone and a soprano saxophone.

Another object of the invention is to provide a novel musical instrument conbining a tenor and soprano saxophone wherein both the tenor and soprano saxophone are modified as compared to standard saxophones.

Another object of the invention is to provide a novel combined and modified tenor and soprano saxophone joined by a plate slideable in a rail to allow the soprano portion to slide relative to the tenor portion for the purpose of achieving a particular tone.

Another object of the invention is to provide a novel combined, modified tenor and soprano saxophone wherein the outlet or discharge ends of each instrument are provided with trumpet bells rather than with standard saxophone outlets.

Another object of the invention is to provide a novel and combined and modified tenor and soprano saxophone sections wherein in the tenor section the G sharp and the lever to operate the G sharp have been removed.

Another object of the invention is to provide a novel and combined and modified tenor and soprano saxophone wherein a tone chamber is secured over the F tone hole of the tenor section for the purpose of keeping the G note in tune.

Another object of the invention is to provide a novel and combined and modified tenor and soprano saxophone wherein in the soprano section the octave key is removed and the post holding it to the instrument is moved downwardly to give clearance for the mouthpiece so that it may be moved for tuning purposes.

These and other objects and advantages of the invention are believed made clear by the following description thereof taken in conjunction with the accompanying drawings wherein:

IN THE DRAWINGS

Figure 1:
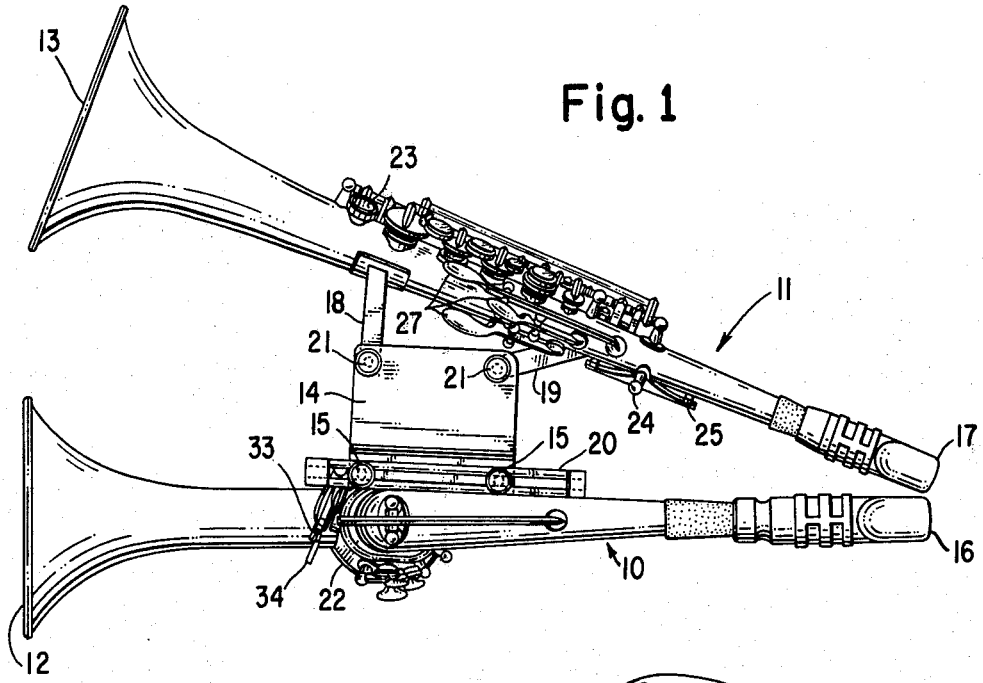
FIG. 1 is a plan view showing the mounting bracket holding the instruments together.
Figure 2:
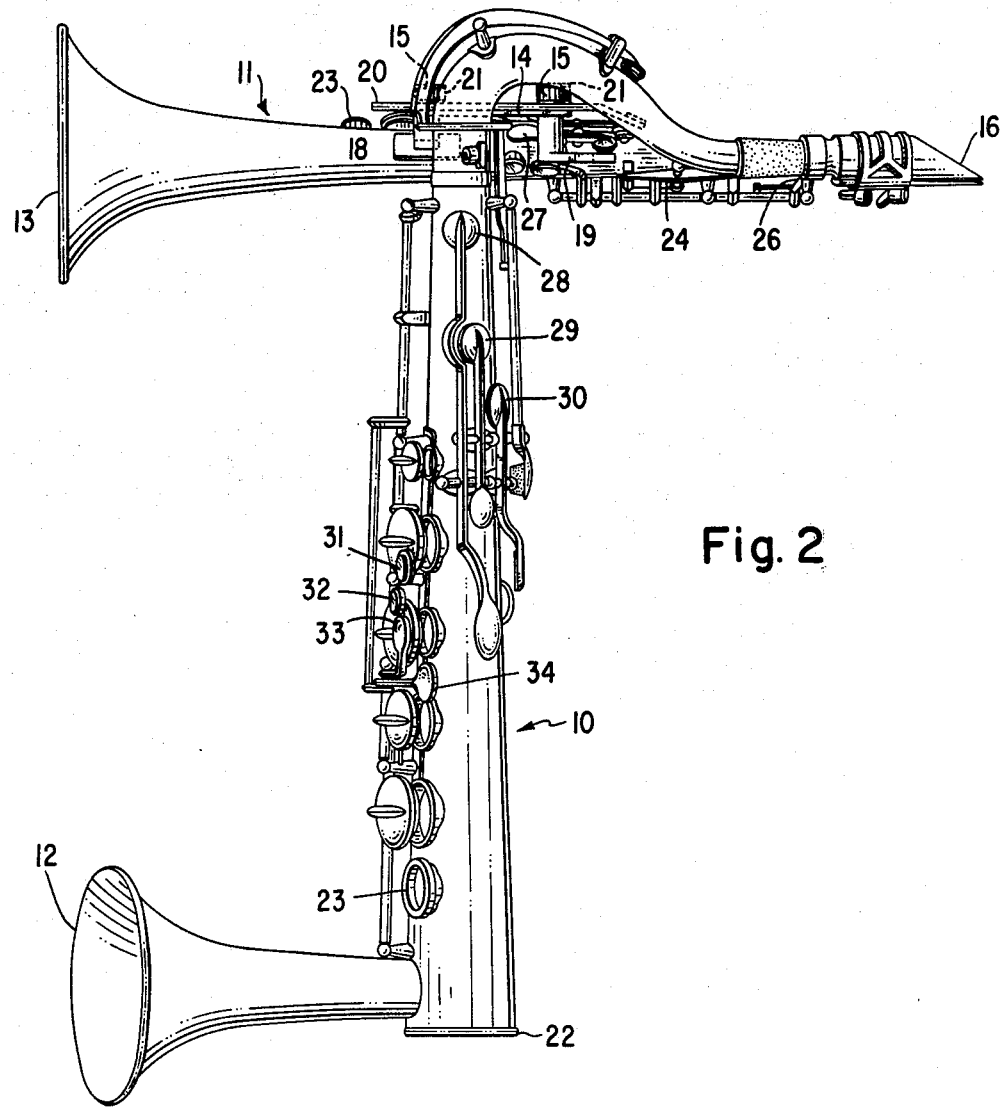
FIG. 2 is a side view showing the two instruments.
Figure 3:
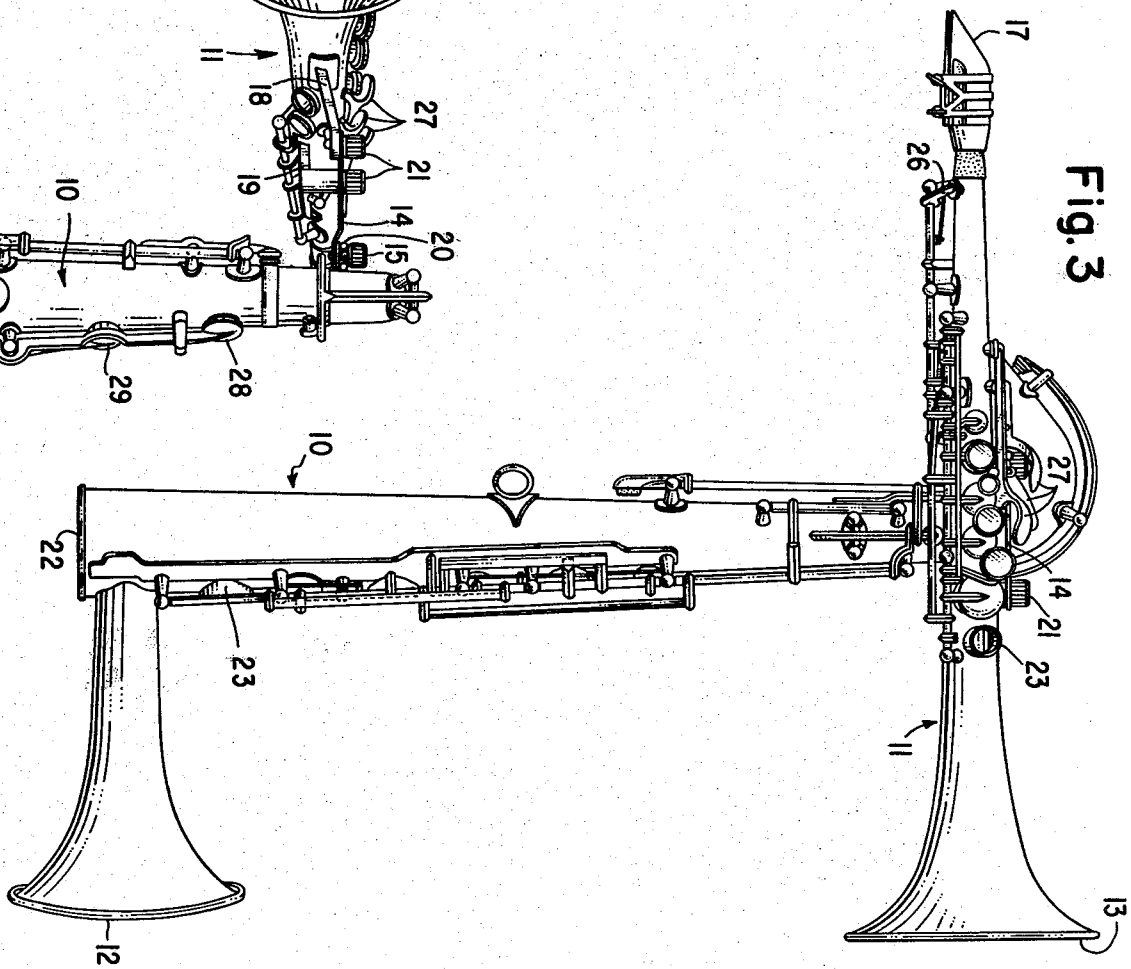
FIG. 3 is a side view opposite of that of FIG. 2.
Figure 4:
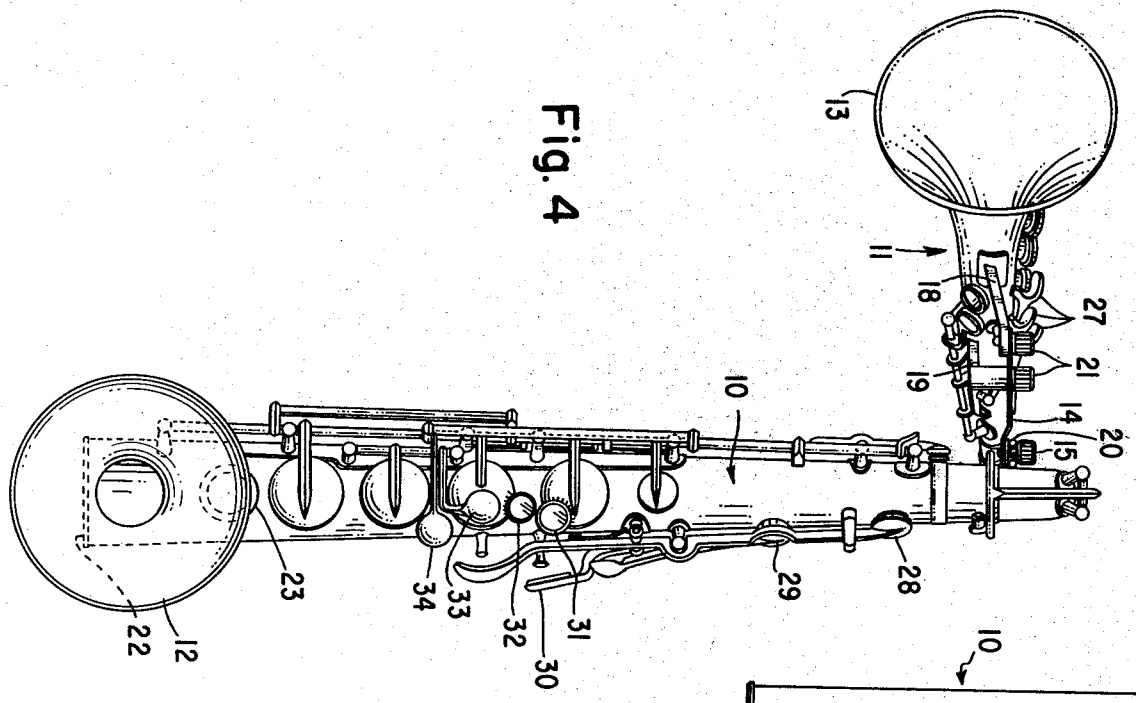
FIG. 4 is a front view of the two instruments.
Figure 5:
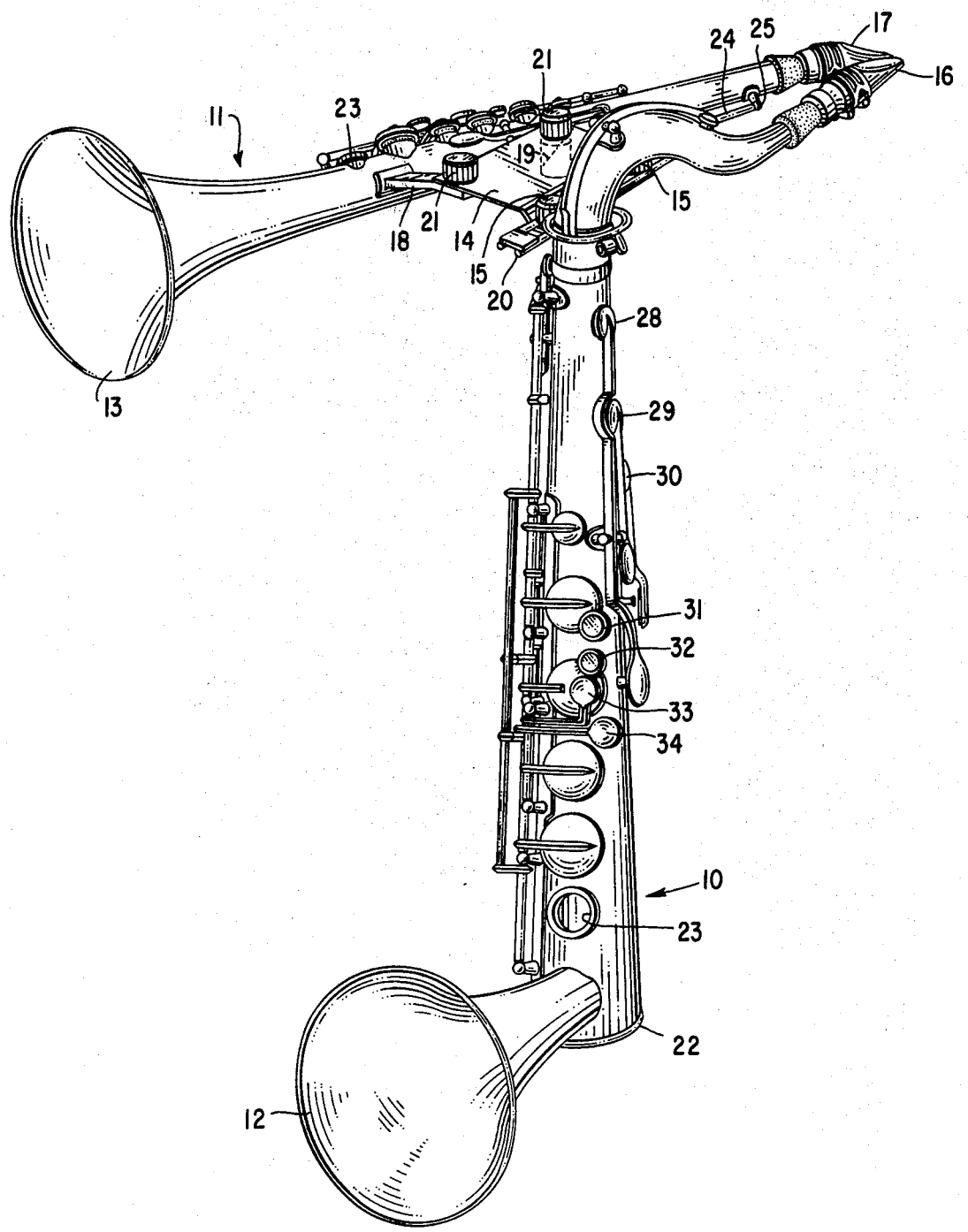
FIG. 5 is a perspective view of the two instruments.

Referring now to the drawings there is shown a modified portion of a B flat tenor saxophone 10 and a modified portion of a B flat straight soprano saxophone 11 each provided with a trumpet bell outlet 12 and 13 and slideably connected together by means of a plate 14 which will allow the soprano portion to slide relative to the tenor portion until such time as the musician has satisfied himself with the musical tone at which time nuts 15 securing the tenor portion to the plate 14 are secured. At this time, neither the tenor nor the soprano section can be moved relative to the other and both mouthpieces 16 and 17 are properly aligned for playing. Brackets 18 and 19 connect the neck of the soprano portion to plate 14 and a rail 20 connects the neck of the tenor portion to plate 14. Nuts 21 are provided to connect plate 14 to bracket 18 and 19. To slide one instrument relative to the other for the purpose of acquiring a particular tone, nuts 15 are loosened and therefore slideable in rail 20 and therefore one instrument can be slid relative to the other. When proper alignment has been accomplished the nuts 15 are tightened and the mouthpieces 16 and 17 can be played at the same time.

As to the tenor portion 10 the G sharp and the lever to operate the G sharp have been removed and are therefore not shown. Further, the basic tenor section is cut off slightly below the F sharp tone hole which therefore is also not shown. A large key cup 22 is then fitted into the bottom of the tenor portion 10 just below where the F sharp tone hone would normally be. The regular trumpet bell 12 is then fitted into the F sharp tone hole. An open cap or washer element known as a tone chamber 23 is secured over the F tone hole for the purpose of keeping the G note in tune.

The soprano section 11 of the instrument is cut off above the normal F sharp tone hole which is therefore not shown and the standard trumpet bell 13 is also fitted to the soprano section as in the tenor section. The octave key 24 and the post 25 holding the octave key to the instrument were moved downwardly from their normal position to give clearance for the mouthpiece so that it could be moved for tuning purposes. A bend 26 is made to the octave key so that it could cover the tone hole without interference with the mouthpiece and the three upper stack keys are bent as at 27 to allow simplified key fingering by the musician.

The notes of a standard B flat tenor saxophone and B flat straight soprano saxophone from which the intruments forming the subject matter of this application were modified, comprise, from top to bottom, starting with the upper most stack, and E tone hole, C tone hole and B flat.

Referring back now to tenor portion 10 of the instrument as modified and which forms the subject matter of this invention the existing keys are F shown as 28, E flat shown as 29, D shown as 30, B shown as 31, B flat shown as 32, A shown as 33, and, G shown as 34.

Referring back to soprano portion 11 of the instrument as modified and which forms the subject matter of this invention the existing keys are: F shown as 28, E flat shown as 29, D shown as 30, B shown as 31, B flat shown as 32, A shown as 33, and, G shown as 34.

In other words, both the tenor and soprano portions of the instrument comprising this invention comprise the same keys.

Thus, what has been described is a unique musical instrument combining a modified portion of a tenor saxophone with a modified portion of a soprano saxophone joined together by means of a bracket whereby one of the two instruments can be moved relative to the other to obtain proper alignment whereby the two instruments can be played simultaneously. Further, it is disclosed that each of the two instruments are provided with their own mouthpieces whereby a musician can play two notes simultaneously. Each instrument is provided with a trumpet bell outlet and both have been modified from the standard B flat tenor saxophone and B flat straight soprano saxophones.

It is to be understood that the invention is not to be restricted to the parts shown but that they may be widely varied within the invention as claimed.

What is claimed is:

1. A musical instrument comprising a tenor saxophone and a soprano saxophone slideably connected together by a plate wherein a bracket connects the neck of the soprano saxophone to said plate and a rail connects the neck of the tenor saxophone to said plate and wherein nuts extend through said plate and said rail and are slideably mounted therein whereby when said nuts are loosened and therefore slideable in said rail one saxophone can be slid relative to the other saxophone until they are properly aligned wherein said tenor saxophone and said soprano saxophone each are fitted with a trumpet bell outlet.

2. The musical instrument of claim 1 wherein a key cup is attached to the bottom of the tenor saxophone slightly below where an F sharp hole would normally be for sealing off the instrument.

3. The musical instrument of claim 2 wherein a standard G sharp and a lever to operate said G sharp have been removed.

4. The musical instrument of claim 3 wherein an open cap or washer element known as a tone chamber is secured over an F tone hole for the purpose of keeping the G note in tune.

5. The musical instrument of claim 4 wherein the soprano saxophone is cut off above the normal F sharp tone hole.

6. The musical instrument of claim 5 wherein a standard octave key and a post holding the octave key to the soprano saxophone are moved downwardly from their normal position to give clearance for a mouthpiece attached to said soprano saxophone so that it may be moved for tuning purposes.

7. The musical instrument of claim 6 wherein said tenor saxophone is modified from a standard tenor saxophone to comprise only the following keys; F, E flat, D, B, B flat, A, and G.

8. The musical instrument of claim 7 wherein said soprano saxophone is modified from a standard soprano saxophone to comprise only the following keys; F, E flat, D, B, B flat, A and G.

* * * * *